US011806570B2

(12) United States Patent
Chuang

(10) Patent No.: US 11,806,570 B2
(45) Date of Patent: Nov. 7, 2023

(54) WRIST EXERCISER AND ROTATION MECHANISM THEREOF

(71) Applicant: NANO-SECOND TECHNOLOGY CO.,LTD., New Taipei (TW)

(72) Inventor: Pei-Sung Chuang, New Taipei (TW)

(73) Assignee: NANO-SECOND TECHNOLOGY CO., LTD., New Taipei (TW)

( * ) Notice: Subject to any disclaimer, the term of this patent is extended or adjusted under 35 U.S.C. 154(b) by 187 days.

(21) Appl. No.: 17/177,705

(22) Filed: Feb. 17, 2021

(65) Prior Publication Data

US 2022/0203155 A1 Jun. 30, 2022

(30) Foreign Application Priority Data

Dec. 30, 2020 (TW) ..... 109217362

(51) Int. Cl.
*A63B 21/22* (2006.01)
*A63B 21/005* (2006.01)
*A63B 23/14* (2006.01)

(52) U.S. Cl.
CPC ..... *A63B 21/222* (2015.10); *A63B 21/0057* (2013.01); *A63B 23/14* (2013.01); *A63B 2209/08* (2013.01)

(58) Field of Classification Search
CPC ..... A63B 21/00178; A63B 21/0053; A63B 21/0054; A63B 21/0056; A63B 21/0057; A63B 21/0058; A63B 21/0059; A63B 21/22; A63B 21/222; A63B 21/4019; A63B 21/4021; A63B 21/4049; A63B 23/14
See application file for complete search history.

(56) References Cited

U.S. PATENT DOCUMENTS 5,800,311 A * 9/1998 Chuang ..... A63B 23/14 482/44
7,033,304 B2 4/2006 Chuang
7,101,315 B2 * 9/2006 Chuang ..... A63B 71/0622 482/3
7,381,155 B2 6/2008 Chuang
7,935,035 B2 * 5/2011 Smith ..... A63B 21/22 482/44
9,463,354 B2 * 10/2016 Chuang ..... A63B 21/222
9,782,623 B2 10/2017 Chuang
9,827,463 B2 * 11/2017 Chuang ..... A63B 23/14
(Continued)

*Primary Examiner* — Loan B Jimenez
*Assistant Examiner* — Zachary T Moore
(74) *Attorney, Agent, or Firm* — Maschoff Brennan

(57) ABSTRACT

A rotation mechanism of a wrist exerciser is provided. The rotation mechanism includes a sleeve ring, a spinning mass, and a driving assembly. The sleeve ring is rotatable along an annular groove. The sleeve ring includes an annular body and a mount component. The annular body has a first mount portion and a first insertion hole respectively located at two opposite sides of the annular body. The mount component has a second mount portion and a second insertion hole. The second mount portion of the mount component is engaged with the first mount portion. Two shaft portions of the spinning mass are respectively and rotatably located in the first insertion hole and the second insertion hole, allowing the spinning mass to be rotatable. The driving assembly includes a stator fixed to the mount component and a rotor mounted on the spinning mass.

9 Claims, 7 Drawing Sheets

(56) References Cited

U.S. PATENT DOCUMENTS

| | | | | |
|---|---|---|---|---|
| 2005/0101454 | A1* | 5/2005 | Dworzan | A63B 21/22 482/110 |
| 2005/0107218 | A1* | 5/2005 | Chuang | A63B 21/222 482/8 |
| 2010/0048359 | A1* | 2/2010 | Chuang | A63B 21/22 482/44 |
| 2012/0329609 | A1* | 12/2012 | Chuang | A63B 21/222 482/44 |
| 2014/0200115 | A1* | 7/2014 | Chuang | A63B 23/14 482/8 |
| 2015/0231445 | A1* | 8/2015 | Chuang | H04Q 9/00 482/2 |

* cited by examiner

WRIST EXERCISER AND ROTATION MECHANISM THEREOF

CROSS-REFERENCE TO RELATED APPLICATIONS

This non-provisional application claims priority under 35 U.S.C. § 119(a) on patent application No(s). 109217362 filed in Taiwan, R.O.C on Dec. 30, 2020, the entire contents of which are hereby incorporated by reference.

TECHNICAL FIELD

The disclosure relates to an exercise device, more particularly to a wrist exerciser and a rotation mechanism thereof that can convert electrical energy to mechanical energy.

BACKGROUND

A wrist exerciser is a device used to excise the wrist part, once the gyroscope inside is going fast enough, a person holding the device can accelerate the spinning mass to higher revolution rates by moving the wrist in a circular motion. The spinning mass produces powerful centrifugal and inertial forces against muscles for building palm, forearm, and finger strength or being used to exercise the wrist as part of physical therapy.

The conventional wrist exercisers are activated by an activation mean, such as a string, a rack, or a battery-driven device, but properly pulling the string or the rack to obtain a suitable spinning speed is not easy for general users, either the pulling is too weak to fail to activate the wrist exerciser, or the pulling is too hard to get unwanted speed boost. Also, these activation means are separated from the wrist exerciser, therefore, are easily lost items for users. Some wrist exercisers employ the activation means inside, but this change results in too much noise during spinning. Accordingly, manufactures are constantly working on improving the above problems.

SUMMARY

The disclosure provides a wrist exerciser and a rotation mechanism that are easy-to-use for a professional or a beginner.

One embodiment of the disclosure provides a rotation mechanism configured to be disposed in an annular groove. The rotation mechanism includes a sleeve ring, a spinning mass, and a driving assembly. The sleeve ring is rotatable along the annular groove. The sleeve ring includes an annular body and a mount component. The annular body has a first mount portion and a first insertion hole respectively located at two opposite sides of the annular body. The mount component has a second mount portion and a second insertion hole respectively located at different portions of the mount component. The second mount portion of the mount component is engaged with the first mount portion of the annular body. The spinning mass includes two shaft portions opposite to each other. The two shaft portions are respectively and rotatably located in the first insertion hole and the second insertion hole of the sleeve ring so as to allow the spinning mass to be rotatable with respect to the sleeve ring. The driving assembly includes a stator and a rotor. The stator is fixed to the mount component of the sleeve ring, and the rotor is mounted on the spinning mass.

Another embodiment of the disclosure provides a wrist exerciser. The wrist exerciser includes a spherical casing and the aforementioned rotation mechanism. The spherical casing includes a first casing, a second casing, and an annular rail. The second casing is detachably mounted on the first casing, and the first casing and the second casing together form an accommodation space therebetween. The annular rail is fixed in the accommodation space, and the annular rail has an annular groove. The rotation mechanism is at least partially located in the accommodation space. The sleeve ring of the rotation mechanism is rotatably disposed in the annular groove.

Still another embodiment of the disclosure provides a wrist exerciser. The wrist exerciser includes a spherical casing and the aforementioned rotation mechanism. The spherical casing includes a first casing and a second casing. The second casing is detachably mounted on the first casing, and the first casing and the second casing together form an accommodation space therebetween and an annular groove connected to the accommodation space. The rotation mechanism is at least partially located in the accommodation space. The sleeve ring of the rotation mechanism is rotatably disposed in the annular groove.

Yet another embodiment of the disclosure provides a rotation mechanism. The rotation mechanism includes a sleeve ring and a spinning mass. The spinning mass is rotatably disposed on the sleeve ring. The spinning mass is rotatable with respect the sleeve ring by a conversion of electrical energy to mechanical energy.

As the rotation mechanisms and the wrist exerciser discussed in the above embodiments, the stator and the rotor of the driving assembly are respectively mounted on the sleeve ring and the spinning mass, such that the spinning mass can be activated as the induced magnetic field causes the rotor begins to rotate. This makes the wrist exerciser having the rotation mechanism easy-to-use for either professionals or beginners.

BRIEF DESCRIPTION OF THE DRAWINGS

The present disclosure will become better understood from the detailed description given herein below and the accompanying drawings which are given by way of illustration only and thus are not intending to limit the present disclosure and wherein.

DETAILED DESCRIPTION

Figure 1:
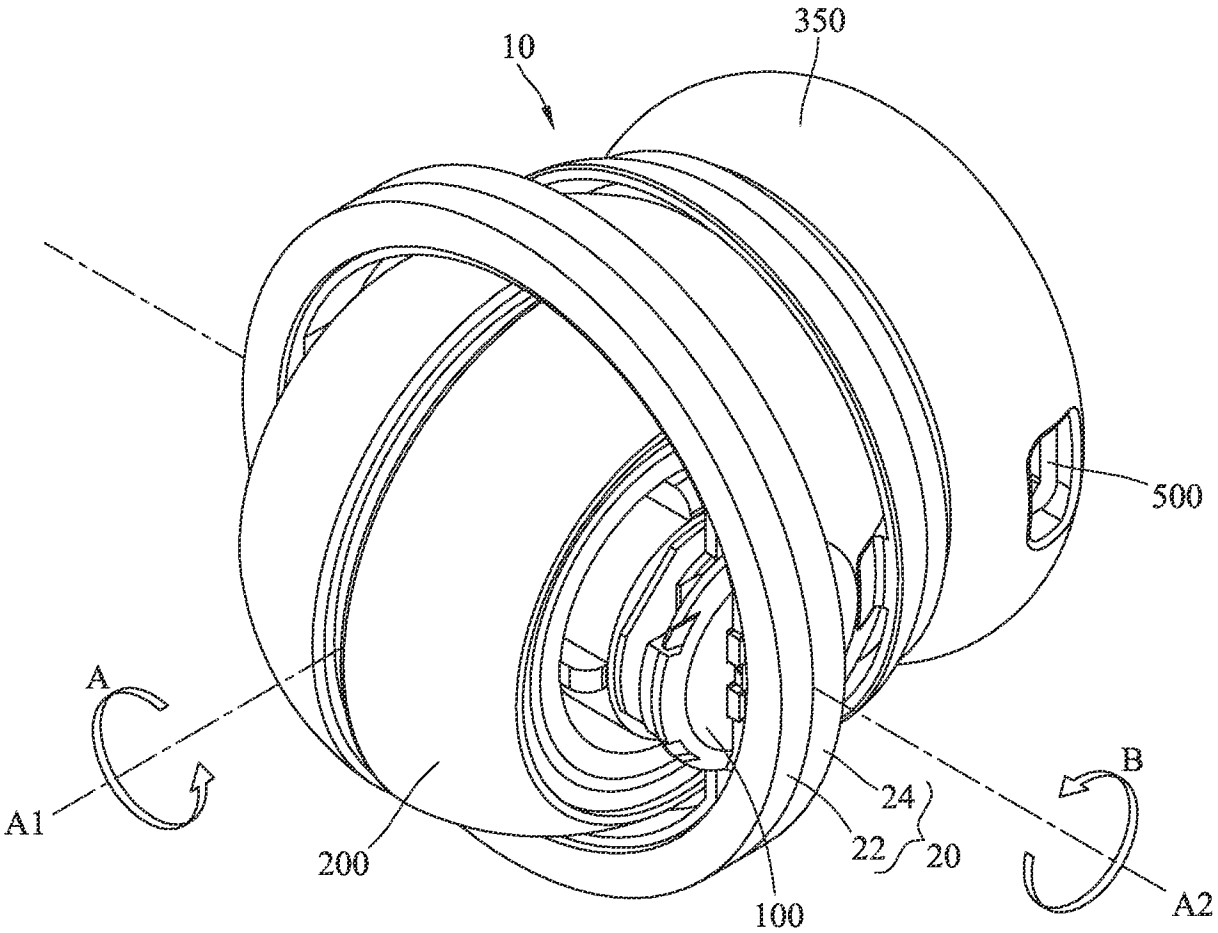
FIG. 1 is a perspective view of a rotation mechanism of a wrist exerciser according to a first embodiment of the disclosure.
Figure 2:
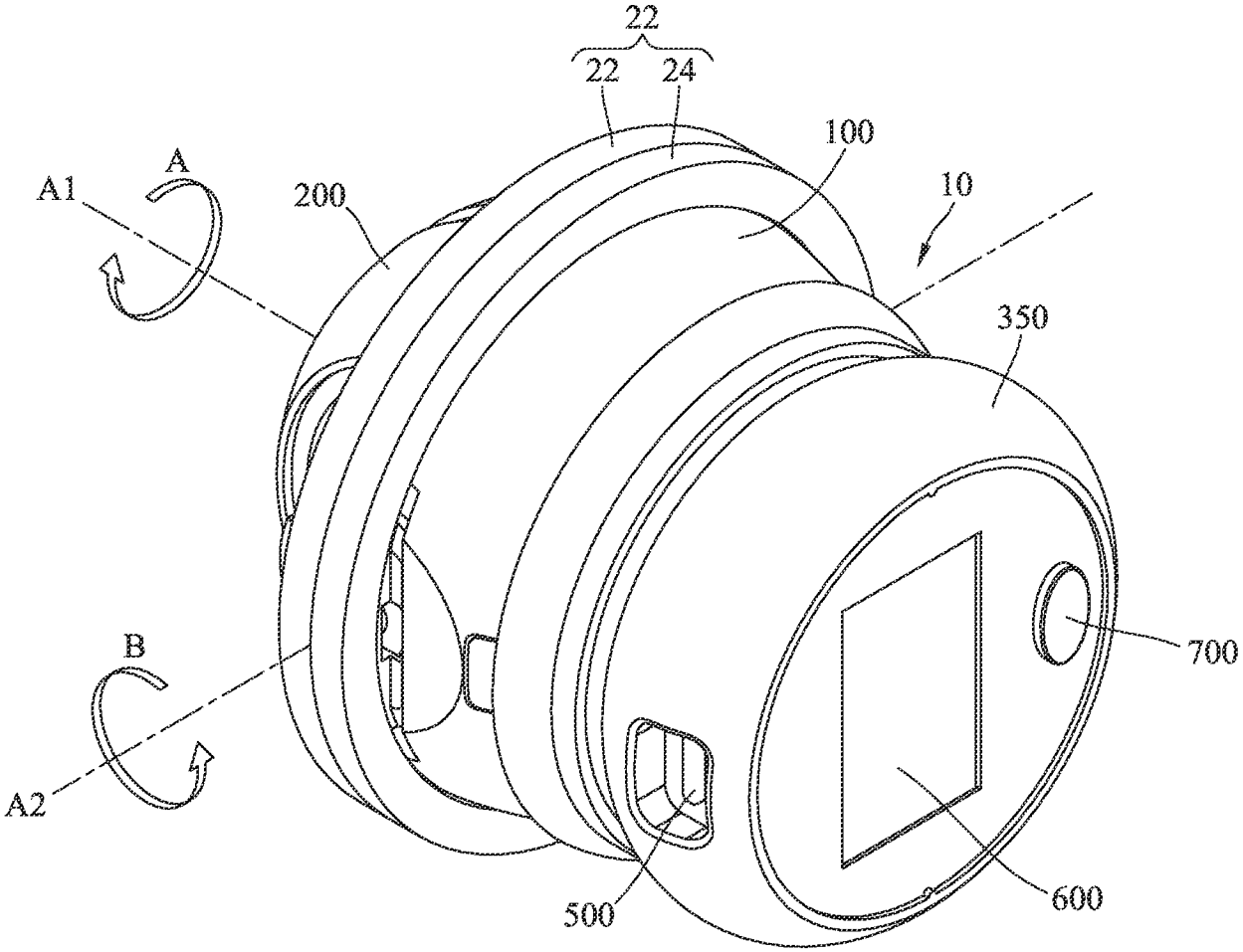
FIG. 2 is another perspective view of the rotation mechanism in FIG. 1.
Figure 3:
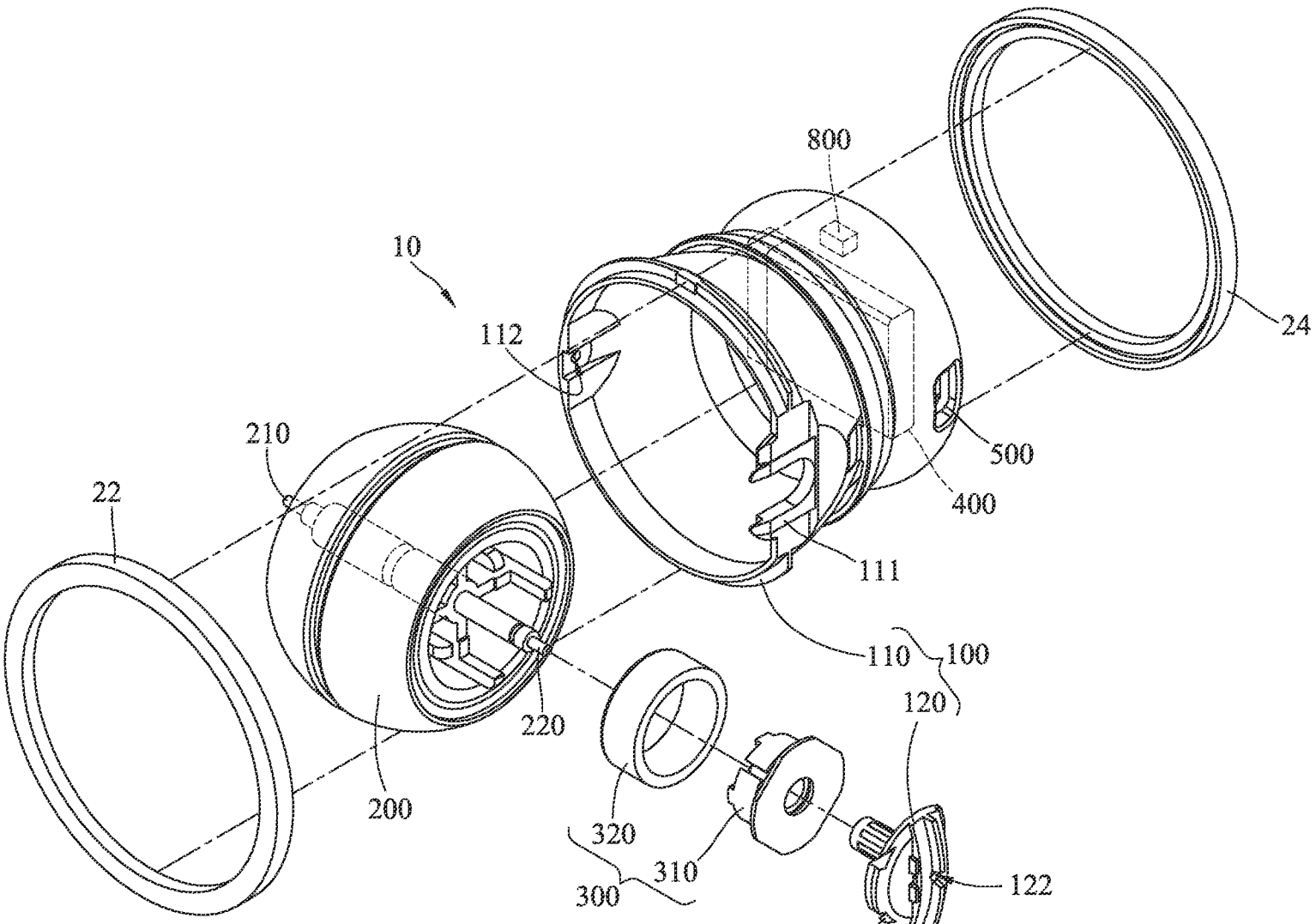
FIG. 3 is an exploded view of the rotation mechanism in FIG. 1.
Figure 4:
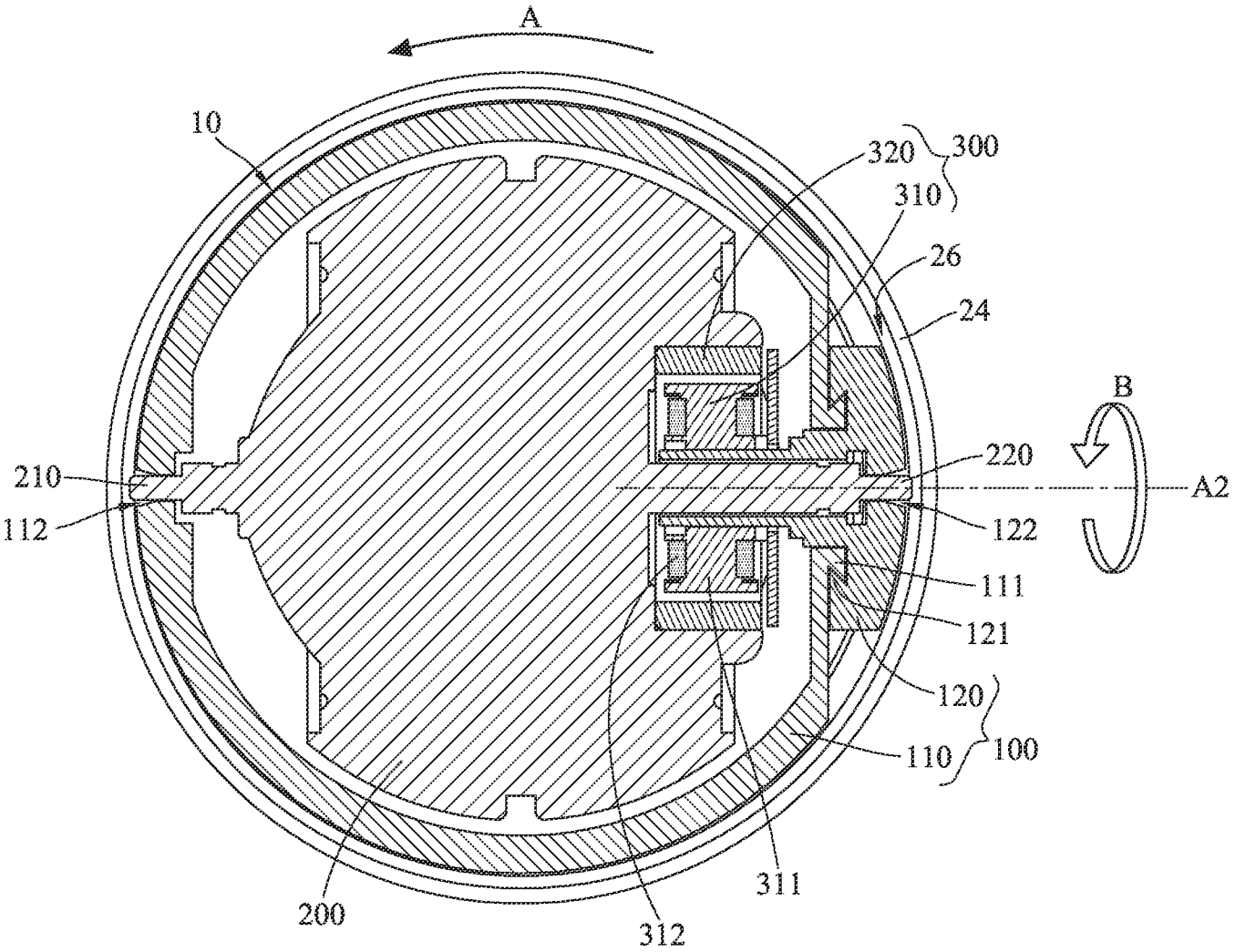
FIG. 4 is a cross-sectional view of the rotation mechanism in FIG. 1.
Figure 5:
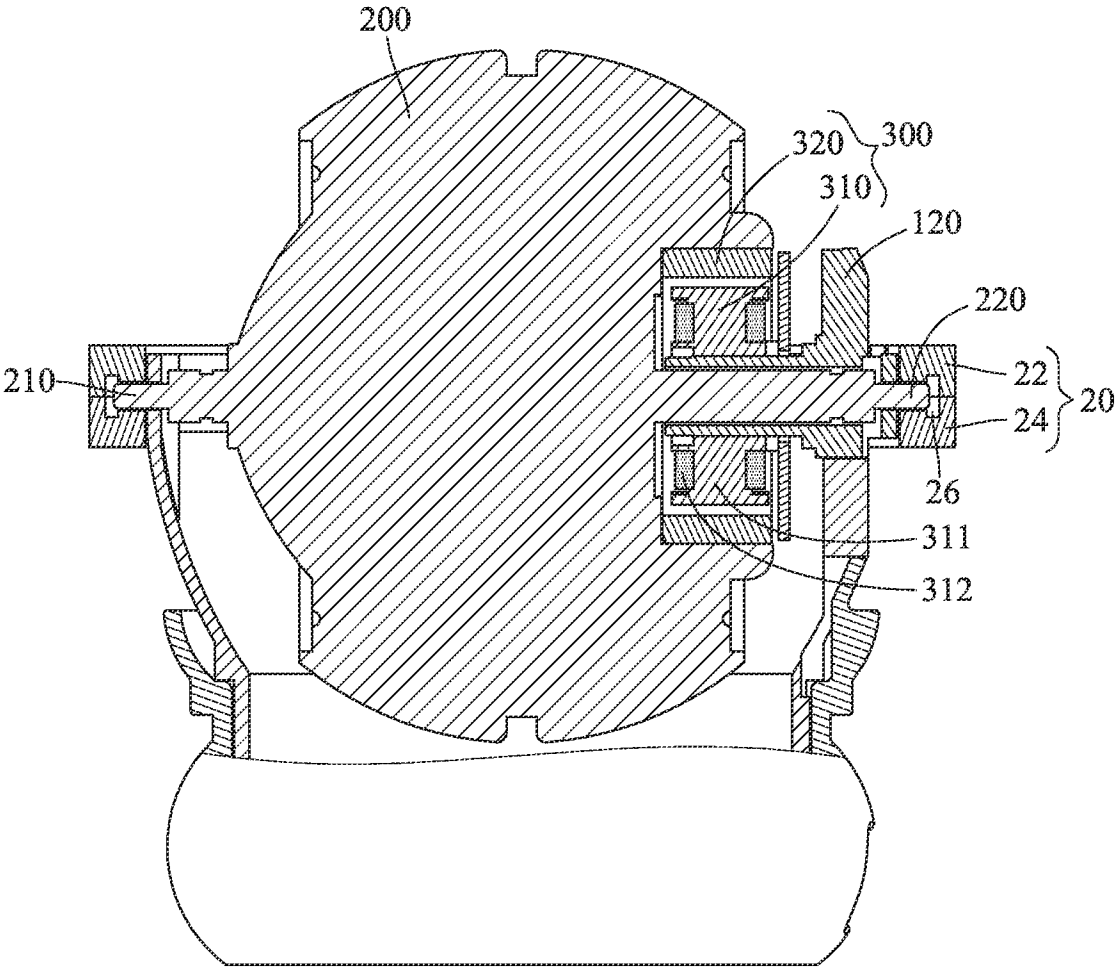
FIG. 5 is another cross-sectional view of the rotation mechanism in FIG. 1.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In addition, the terms used in the present disclosure, such as technical and scientific terms, have its own meanings and can be comprehended by those skilled in the art, unless the terms are additionally defined in the present disclosure. That is, the terms used in the following paragraphs should be read on the meaning commonly used in the related fields and will not be overly explained, unless the terms have a specific meaning in the present disclosure.

Referring to FIGS. 1 to 5, there are shown a perspective view of a rotation mechanism 10 of a wrist exerciser according to a first embodiment of the disclosure, another perspective view of the rotation mechanism 10 in FIG. 1, an exploded view of the rotation mechanism 10 in FIG. 1, a cross-sectional view of the rotation mechanism 10 in FIG. 1, and another cross-sectional view of the rotation mechanism 10 in FIG. 1.

In this embodiment, the rotation mechanism 10 is movably disposed on an annular rail 20. The annular rail 20 can be installed in a handheldable casing (not shown) of the wrist exerciser. The casing is made of, for example, metal, plastic, or wood. The annular rail 20 includes a first ring 22 and a second ring 24. The first ring 22 is in contact with the second ring 24, and the recesses respectively on the inner surfaces of the first ring 22 and the second ring 24 together form an annular groove 26.

The rotation mechanism 10 includes a sleeve ring 100, a spinning mass 200, and a driving assembly 300. The sleeve ring 100 is rotatable along the annular groove 26 of the annular rail 20, and the sleeve ring 100 is rotatable with respect to the annular rail 20 about a first axis A1 (e.g., along a direction A shown in FIG. 1).

The sleeve ring 100 includes an annular body 110 and a mount component 120. The annular body 110 has a first mount portion 111 and a first insertion hole 112 respectively located at two opposite sides of the annular body 110. The mount component 120 has a second mount portion 121 and a second insertion hole 122 respectively located at different portions of the mount component 120. The second mount portion 121 of the mount component 120 and the first mount portion 111 of the annular body 110 are engageable with each other. When the second mount portion 121 of the mount component 120 is engaged with the first mount portion 111 of the annular body 110, the first insertion hole 112 and the second insertion hole 122 are respectively located at two opposite sides of the sleeve ring 100.

The spinning mass 200 includes two shaft portions 210 and 220 located at opposite sides of the spinning mass 200. The shaft portions 210 and 220 are respectively and rotatably inserted into the first insertion hole 112 and the second insertion hole 122 of the sleeve ring 100, such that the spinning mass 200 is rotatable with respect to the sleeve ring 100 about a second axis A2 (e.g., along a direction B). The second axis A2 is orthogonal to the first axis A1.

The driving assembly 300 is, for example, a motor. The driving assembly 300 includes a stator 310 and a rotor 320. The stator 310 includes a stator yoke 311 and a coil 312 wound on the stator yoke 311. The stator yoke 311 is fixed to the mount component 120 of the sleeve ring 100. The rotor 320 is, for example, a magnet. The rotor 320 is mounted on the spinning mass 200. When an electric current goes along the coil 312 of the stator 310, it creates a magnetic field in the rotor 320 (i.e., the magnet), causing it to spin around the stator 310. And the spinning of the rotor 320 drives the spinning mass 200 to spin. In short, the spinning mass 200 can be activated by the driving assembly 300.

In this embodiment, the rotation mechanism 10 may further include a seat body 350 and a battery 400. The seat body 350 is fixed to the sleeve ring 100. The battery 400 is, for example, a primary battery or a rechargeable battery. The battery 400 is disposed in the seat body 350 and electrically connected to the coil 312 of the stator 310. The battery 400 can provide electricity to the driving assembly 300. In this embodiment, the seat body 350 and the sleeve ring 100 are two independent pieces, but the present disclosure is not limited thereto; in some other embodiments, the seat body and the sleeve ring may be formed into a single piece.

In one embodiment that the battery 400 is a rechargeable battery, the rotation mechanism 10 may further include a charging connector 500 arranged on the seat body 350 and electrically connected to the battery 400, allowing the battery 400 to be recharged.

In this embodiment, the rotation mechanism 10 may further include a display panel 600 arranged on a side of the seat body 350 and electrically connected to the battery 400 and the driving assembly 300, allowing to show the remaining capacity of the battery 400 or other required information (e.g., spinning speed).

In this embodiment, the rotation mechanism 10 may further include an activation button 700 arranged on a side of the seat body 350. As shown, the activation button 700 can be arranged aside the display panel 600. The activation button 700 is electrically connected to the display panel 600 and the driving assembly 300, allowing user to activate or inactivate the display panel 600 and the driving assembly 300.

In this embodiment, the rotation mechanism 10 may further include a sensor 800. The sensor 800 is configured to detect the information of the spinning mass 200, and the inactivation of the driving assembly 300 is based on the detected information. In specific, the sensor 800 is, for example, a time meter. The sensor 800 starts to count the spinning time of the spinning mass 200 once the spinning mass 200 is activated by the driving assembly 300. When the spinning time exceeds a predetermined time period, the driving assembly 300 is inactivated. The predetermined time period may be set by user. By doing so, the spinning mass 200 will keep moving without receiving further power or even resistance from the driven assembly 300.

In one embodiment, the sensor 800 may be a tachometer for detecting the rotation speed of the spinning mass 200 and determining whether it exceeds a predetermined value. When the rotation speed of the spinning mass 200 exceeds a predetermined value, the driving assembly 300 will be inactivated. The purpose of this arrangement is illustrated in the previous paragraph, thus it will not be repeatedly described hereinafter.

The aforementioned the rotation mechanism 10 is one of embodiments of the disclosure that convert electrical energy to mechanical energy and is not intended to limit the disclosure; in some other embodiments, without deviating the spirit of converting electrical energy to mechanical energy, the rotation mechanism may be simplified to include a sleeve ring and a spinning mass. In such a case, the sleeve ring is rotatable along the annular groove. The spinning mass is rotatably disposed on the sleeve ring. The spinning mass can rotate with respect to the sleeve by the conversation of electrical energy into mechanical energy.

One of the means to convert the electrical energy to the mechanical energy includes providing electric current to a stator of a driving assembly by a battery inside the wrist exerciser, creating a magnetic field via the interaction between the stator and a rotor of the driving assembly to rotate the rotor so as to rotate a spinning mass of the wrist exerciser, and increasing the rotation speed of the spinning mass to a predetermined value. When the rotation speed of the spinning mass exceeds the predetermined value, the battery stops providing the electric current to the stator.

Figure 6:
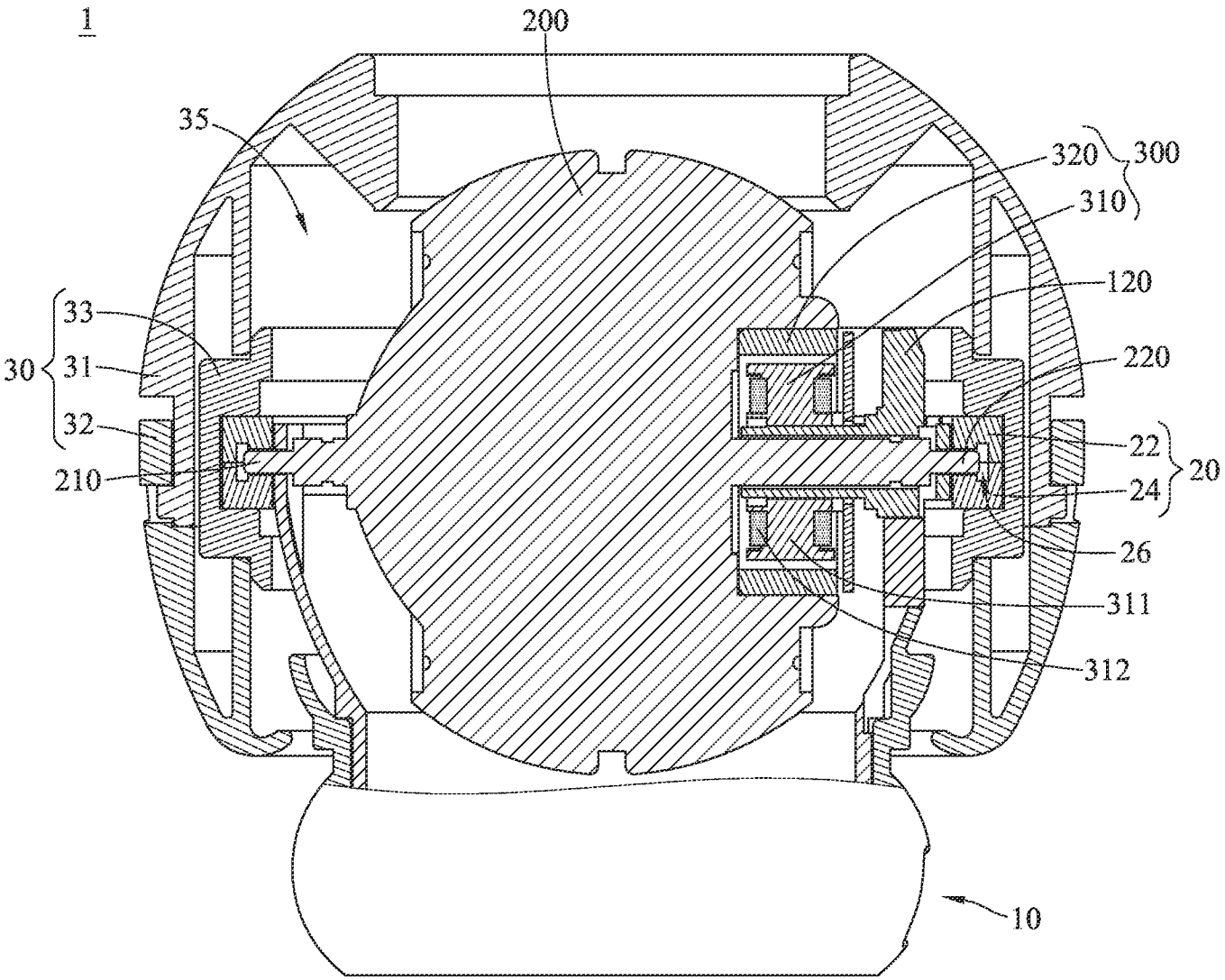
FIG. 6 is a perspective view of a wrist exerciser according to a second embodiment of the disclosure.

Referring to FIG. 6, there is shown a perspective view of a wrist exerciser 1 according to a second embodiment of the disclosure. In this embodiment, the wrist exerciser 1 includes a spherical casing 30 and a rotation mechanism 10. The spherical casing 30 includes a first casing 31, a second casing 32, a buffering pad 33, and an annular rail 20. The second casing 32 is detachably mounted on the first casing 31, and the first casing 31 and the second casing 32 together form an accommodation space 35 therebtweeen. The first casing 31 and the second casing 32 are made of, for example, metal or plastic. The annular rail 20 is fixed in the accommodation space 35 and connected to the first casing 31 and the second casing 32 via the buffering pad 33. The buffering pad 33 can reduce or absorb the impact or vibration that the annular rail 20 applies on the first casing 31 and the second casing 32. The buffering pad 33 may be made of soft and flexible material, such as rubber, silicone, or other suitable materials.

Note that the buffering pad 33 is optional and not intended to limit the disclosure; in some other embodiments, the wrist exerciser may not include the buffering pad, and the annular rail may be directly connected to the first casing and the second casing.

The annular rail 20 may have an annular groove 26. The rotation mechanism 10 is partially located in the accommodation space 35, and the sleeve ring 100 of the rotation mechanism 10 is rotatably disposed in the annular groove 26. In this embodiment, the rotation mechanism 10 is the same as that of the previous embodiment, thus it will not repeatedly introduce the rotation mechanism 10 hereinafter.

Figure 7:
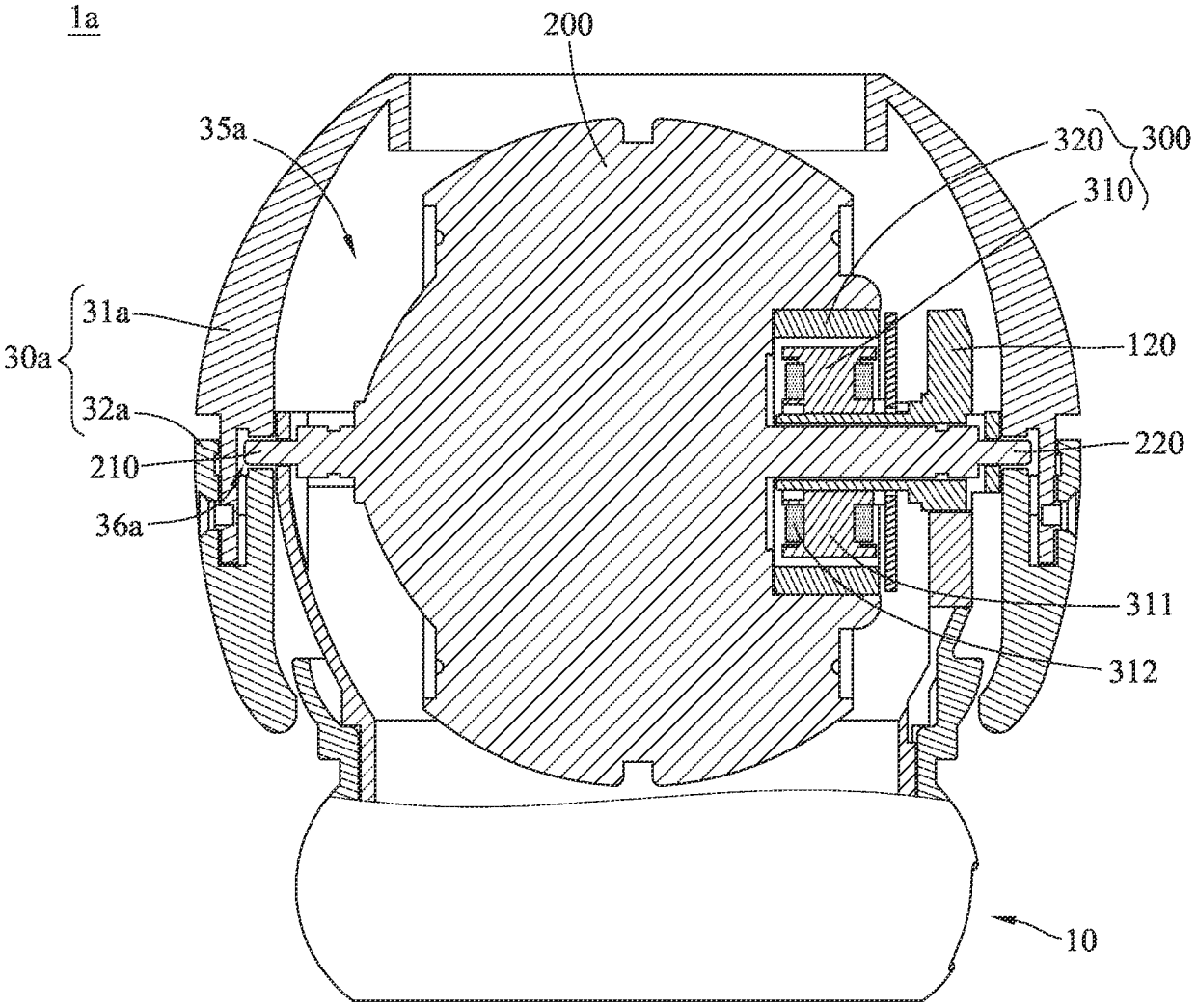
FIG. 7 is a perspective view of a wrist exerciser according to a third embodiment of the disclosure.

Referring to FIG. 7, there is a perspective view of a wrist exerciser 1*a* according to a third embodiment of the disclosure. In this embodiment, the wrist exerciser 1*a* includes a spherical casing 30*a* and a rotation mechanism 10. The spherical casing 30*a* includes a first casing 31*a* and a second casing 32*a*. The second casing 32*a* is detachably mounted on the first casing 31*a*, and the first casing 31*a* and the second casing 32*a* together form an accommodation space 35*a* therebetween and an annular groove 36*a* connected to the accommodation space 35*a*. The first casing 31*a* and the second casing 32*a* are, for example, made of metal or plastic.

The rotation mechanism 10 is at least partially located in the accommodation space 35*a*, and the sleeve ring 100 of the rotation mechanism 10 is rotatably disposed in the annular groove 36*a*. In this embodiment, the rotation mechanism 10 is the same as that of the previous embodiment, thus it will not repeatedly introduce the rotation mechanism 10 hereinafter.

As the rotation mechanisms and the wrist exerciser discussed in the above embodiments, the stator and the rotor of the driving assembly are respectively mounted on the sleeve ring and the spinning mass, such that the spinning mass can be activated as the induced magnetic field causes the rotor begins to rotate. This makes the wrist exerciser having the rotation mechanism easy-to-use for either professionals or beginners.

In addition, the sensor can obtain the information of the spinning mass, and the inactivation of driving assembly is based on the information detected by the sensor. As such, inactivating the driving assembly can prevent the motivation provided by the driven assembly from causing resistance to the spinning or rotation of the spinning mass of the wrist exerciser.

It will be apparent to those skilled in the art that various modifications and variations can be made to the present disclosure. It is intended that the specification and examples be considered as exemplary embodiments only, with a scope of the disclosure being indicated by the following claims and their equivalents.

What is claimed is:

1. A rotation mechanism of a wrist exerciser, configured to be disposed in an annular groove, comprising:

a sleeve ring, rotatable along the annular groove, wherein the sleeve ring comprises an annular body and a mount component, the annular body has a first mount portion and a first insertion hole respectively located at two opposite sides of the annular body, the mount component has a second mount portion and a second insertion hole respectively located at different portions of the mount component, and the second mount portion of the mount component is engaged with the first mount portion of the annular body;

a spinning mass, comprising two shaft portions opposite to each other, wherein the two shaft portions are respectively and rotatably located in the first insertion hole and the second insertion hole of the sleeve ring so as to allow the spinning mass to be rotatable with respect to the sleeve ring; and a driving assembly, comprising a stator and a rotor, wherein the stator is directly fixed to the mount component of the sleeve ring, and the rotor is directly mounted on the spinning mass;

wherein the driving assembly is a motor, the stator comprises a stator yoke and a coil, the stator yoke is fixed to the mount component, the coil is wound on the stator yoke, and the rotor is a magnet;

wherein the rotation mechanism further comprises a seat body and a battery, the seat body is fixed to the sleeve ring, and the battery is disposed in the seat body and electrically connected to the coil of the stator.

2. The rotation mechanism according to claim 1, wherein the stator interacts with the rotor to create a magnetic field for rotating the rotor to rotate the spinning mass.

3. The rotation mechanism according to claim 1, further comprising a charging connector, wherein the charging connector is arranged on the seat body and electrically connected to the battery.

4. The rotation mechanism according to claim 1, further comprising a display panel disposed on the seat body and electrically connected to the battery and the driving assembly.

5. The rotation mechanism according to claim 4, further comprising an activation button, wherein the activation button is disposed on the seat body and electrically connected to the driving assembly for an activation or inactivation of the driving assembly.

6. The rotation mechanism according to claim 1, further comprising a sensor, wherein the sensor is configured to detect an information of the spinning mass, and an inactivation of the driving assembly is based on the information of the spinning mass detected by the sensor.

7. The rotation mechanism according to claim 6, wherein the sensor is a time meter.

8. The rotation mechanism according to claim 6, wherein the sensor is a tachometer.

9. The rotation mechanism according to claim 1, wherein the sleeve ring is rotatable with respect to the annular groove about a first axis, and the spinning mass is rotatable with respect to the sleeve ring about a second axis, and the second axis is orthogonal to the first axis.

* * * * *